US005619316A

United States Patent [19]

Shoji et al.

[11] Patent Number: 5,619,316

[45] Date of Patent: Apr. 8, 1997

[54] IMAGE FORMING APPARATUS

[75] Inventors: Hisashi Shoji, Kawasaki; Hidetoshi Yano, Yokohama; Tsukuru Kai, Fujisawa; Yoshiko Ishii, Tsukuba; Nobuto Yokokawa, Gotenba; Masako Suzuki, Yokohama; Yukiko Iwasaki, Tokyo, all of Japan

[73] Assignee: Ricoh Company, Ltd., Tokyo, Japan

[21] Appl. No.: 595,502

[22] Filed: Feb. 1, 1996

[30] Foreign Application Priority Data

Feb. 2, 1995 [JP] Japan ..... 7-016229

[51] Int. Cl.[6] ..... G03G 21/00; G03G 15/00

[52] U.S. Cl. ..... 399/359; 399/43; 399/99

[58] Field of Search ..... 355/269, 296–298, 355/204, 208, 246; 430/125; 118/652

[56] References Cited

U.S. PATENT DOCUMENTS

| | | | |
|---|---|---|---|
| 5,124,757 | 6/1992 | Ikegawa | 355/296 |
| 5,495,325 | 2/1996 | Nagahara | 355/298 |

FOREIGN PATENT DOCUMENTS

| | | |
|---|---|---|
| 60-88977 | 5/1985 | Japan . |
| 1-161287 | 6/1989 | Japan . |
| 2-127661 | 5/1990 | Japan . |
| 4-360175 | 12/1992 | Japan . |
| 6-51672 | 2/1994 | Japan . |

*Primary Examiner*—Matthew S. Smith

*Attorney, Agent, or Firm*—Oblon, Spivak, McClelland, Maier & Neustadt, P.C.

[57] ABSTRACT

In an image forming apparatus, a toner collection mode is executed when a series of image formation modes ends and when the image formation mode is continuously repeated a preselected number of times. A toner image sensing mode for sensing a reflection density from a reference toner image is executed every time the image formation mode is repeated a preselected number of times. The apparatus is capable of surely and efficiently removing toner left on an image carrier after image transfer, and collecting the reference toner image with a developing unit. The reference toner image is prevented from contaminating an image transferring unit and a cleaning unit.

5 Claims, 12 Drawing Sheets

IMAGE FORMING APPARATUS

BACKGROUND OF THE INVENTION

The present invention relates to an electrophotographic image forming apparatus capable developing a latent image electrostatically formed on an image carrier with a dry toner to thereby produce a corresponding toner image.

An electronic copier, facsimile apparatus, printer or similar electrophotographic image forming apparatus having the above capability is operable at a high speed with plain papers and insures high image quality. An image forming process particular to this kind of apparatus is as follows. While an image carrier formed of a photoconductive material is rotated, a charger uniformly charges the surface of the image carrier. An exposing device scans the charged surface of the image carrier with a light beam for thereby electrostatically forming a latent image thereon. A developing unit develops the latent image with a charged toner and thereby produces a corresponding toner image. An image transferring unit transfers the toner image from the image carrier to a plain paper or similar recording medium. A fixing unit fixes the toner image on the paper by applying heat and pressure thereto. After the image transfer, a cleaning unit cleans or initializes the surface of the image carrier to prepare it for the next image formation.

Assume that the image carrier is uniformly charged to the negative polarity by the charger. Then, there are available a negative-to-positive and a positive-to-positive image forming process. In the negative-to-negative process, the exposing device illuminates the portions of the image carrier where the toner should be deposited. The developing unit charges the toner for developing the latent image to the negative polarity, while the image transferring unit charges the recording medium to the positive polarity. In the positive-to-positive process, the exposing device illuminates the background area of the image carrier. The developing unit charges the toner for developing the latent image to the positive polarity, while the image transferring unit charges the recording medium to the negative polarity. The negative-to-negative process and positive-to-positive process are executed mainly with a digital copier and printer and with an analog copier, respectively.

To clean the image carrier, the cleaning device has customarily been provided with an elastic blade or a fur brush, elastic roller or magnet brush which is rotatable. The blade is abutted against the surface of the image carrier so as to scrape off the toner remaining on the image carrier. The brush or the roller is rubbed against the surface of the image carrier while in rotation, thereby collecting the toner from the image carrier. Today, a toner having a small particle size and spherical configuration is available in order to enhance image quality. Because this kind of toner cannot be easily removed from the image carrier, use is often made of an electric bias, as disclosed in Japanese Patent Laid-Open Publication No. 5-61388 by way of example. An electric bias scheme taught in this document uses cleaning means implemented as a fur brush and reverses the polarity of the toner left on the image carrier by frictional charging.

On the other hand, there is an increasing demand for a toner recycling engine which saves natural resources and does not need maintenance. There has been proposed an engine including an exclusive path for conveying the toner from the cleaning unit to the developing unit. Japanese Patent Publication No. 61-3027 and Japanese Patent Laid-Open Publication No. 6-51672 each discloses an engine in which the toner removed from the image carrier by the cleaning means is again deposited on the image carrier and then collected by the developing device.

It is preferable to use a two-ingredient type developer, i.e., a toner and carrier mixture from the high-speed recording and stable developing process standpoint. The prerequisite with this kind of developer is that the ratio in weight of the toner to the developer, i.e., the toner concentration of the developer be controlled. Usually, a uniform latent image is formed in a part of the area of the image carrier from which the toner will not be transferred to the recording medium. This latent image is developed by the developing unit under constant conditions to turn out a reference toner image. A reflection density from the reference toner image is optically sensed by a density sensor. The output signal of the density sensor is used to control the replenishment of fresh toner into the developing unit or the developing conditions. For example, when the amount of toner forming the reference toner image is short of a preselected value, as indicated by the sensor output, fresh toner is replenished from a toner bottle into the developing unit. Although the toner concentration may be determined in terms of the transmissibility, electric capacity or inductance of the developer existing in the developing unit, this kind of approach lacks accuracy.

What is required of the image forming apparatus is a system which uses the toner and carrier mixture, allows the cleaning unit to remove the toner from the image carrier with an electric bias, and causes the developing unit to collect the removed toner. However, such a system brings about some problems ascribable to the reference toner image, as follows. Assume that when the toner collected by the cleaning unit is to be again deposited on the image carrier, the reference toner image arrives at the cleaning unit. Then, it is likely that the toner opposite in polarity to the toner in the developing unit remains on the image carrier without being collected by the cleaning unit and coheres on eh image carrier. Further, if the reference image is deposited on the cleaning unit, it is likely that the reference image is returned to the image carrier in the event of the next image formation, thereby smearing the resulting image. In addition, the toner of the reference toner image is apt to firmly adhere to the image carrier and thereby deteriorate the expected function of the image carrier. None of Japanese Patent Laid-Open Publication Nos. 5-61388 and Japanese Patent Publication No. 61-3027 mentioned earlier addresses to the above problems.

SUMMARY OF THE INVENTION

It is therefore an object of the present invention to provide an image forming apparatus capable of effecting the removal of a toner left on an image carrier after image transfer and the collection of the removed toner and a reference toner image by a developing unit surely and efficiently.

It is another object of the present invention to provide an image forming apparatus capable of collecting a reference toner image with a developing unit without contaminating an image transferring unit and a cleaning unit.

In accordance with the present invention, an image forming apparatus is selectively operable in any one of an image formation mode for uniformly charging a photoconductive image carrier by a charging unit, optically exposing the image carrier to thereby electrostatically form a latent image, developing the latent image by a developing unit storing a toner and carrier mixture to thereby form a corresponding toner image, transferring the toner image to a recording medium by an image transferring unit, electrically collecting the toner left on the recording medium by a cleaning unit, and fixing the toner image transferred to the recording medium by a fixing unit; a toner collection mode for transferring the toner from the cleaning unit to the image carrier, and collecting the toner in the developing unit; and a toner image sensing mode for forming a reference toner image on the image carrier, sensing a reflection density from the reference toner image by a density sensor, and operating, based on the output of the density sensor, a toner replenishing section for replenishing a fresh toner to the developing unit, or setting a developing condition matching the output of the density sensor. The toner collection mode is executed when a series of image formation modes ends and every time the image formation mode is continuously repeated a preselected number of times. The toner image sensing mode is executed every time the image formation mode is repeated a preselected number of times.

Also, in accordance with the present invention, in an image forming apparatus selectively operable in any one of the above three different modes, there are executed a series of steps of determining, after the image formation mode, whether or not the toner image sensing mode is necessary, executing, if the toner image sensing mode is necessary, the toner collection mode after the toner image sensing mode, determining, if the toner image sensing means is not necessary, whether or not the toner collection mode is necessary, executing the toner collection mode if the toner collection mode is necessary, and setting up a stand-by state for awaiting the image formation mode.

Further, in accordance with the present invention, an image forming apparatus selectively operable in any one of the above three different modes has a bias power source for applying a bias voltage to the cleaning unit such that the cleaning unit does not contact the reference toner image in the toner image sensing mode, and such that an electric field for transferring the toner charged by the cleaning unit to the cleaning unit is formed between the image carrier and the cleaning unit in the image formation mode. A controller prevents, in the toner image sensing mode, the image transferring unit from contacting the reference toner image, and then sets up the toner collection mode after the reference toner image has moved away from the cleaning unit.

Furthermore, in accordance with the present invention, an image forming apparatus selectively operable in any one of the above three different modes has a bias power source for applying a bias voltage to the cleaning unit such that the cleaning unit does not contact the reference toner image in the toner image sensing mode, and such that an electric field for transferring the toner charged by the cleaning unit to the cleaning unit is formed between the image carrier and the cleaning unit in the image formation mode. A controller renders, in the toner image sensing mode, the transferring unit inoperative, causes the bias power source to apply a bias voltage identical in polarity with a charge of the toner stored in the developing unit to the cleaning unit, and then sets up the toner collection mode after the reference toner image has moved away from the cleaning means.

Moreover, in accordance with the present invention, an image forming apparatus selectively operable in any one of the above three different modes has a bias power source for applying, in the toner image sensing mode, a bias voltage to the cleaning unit such that an electric field formed between the image carrier and the cleaning unit is the same as in the toner collection mode. A controller sets up the toner collection mode immediately after the reference toner image has moved away from the cleaning means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
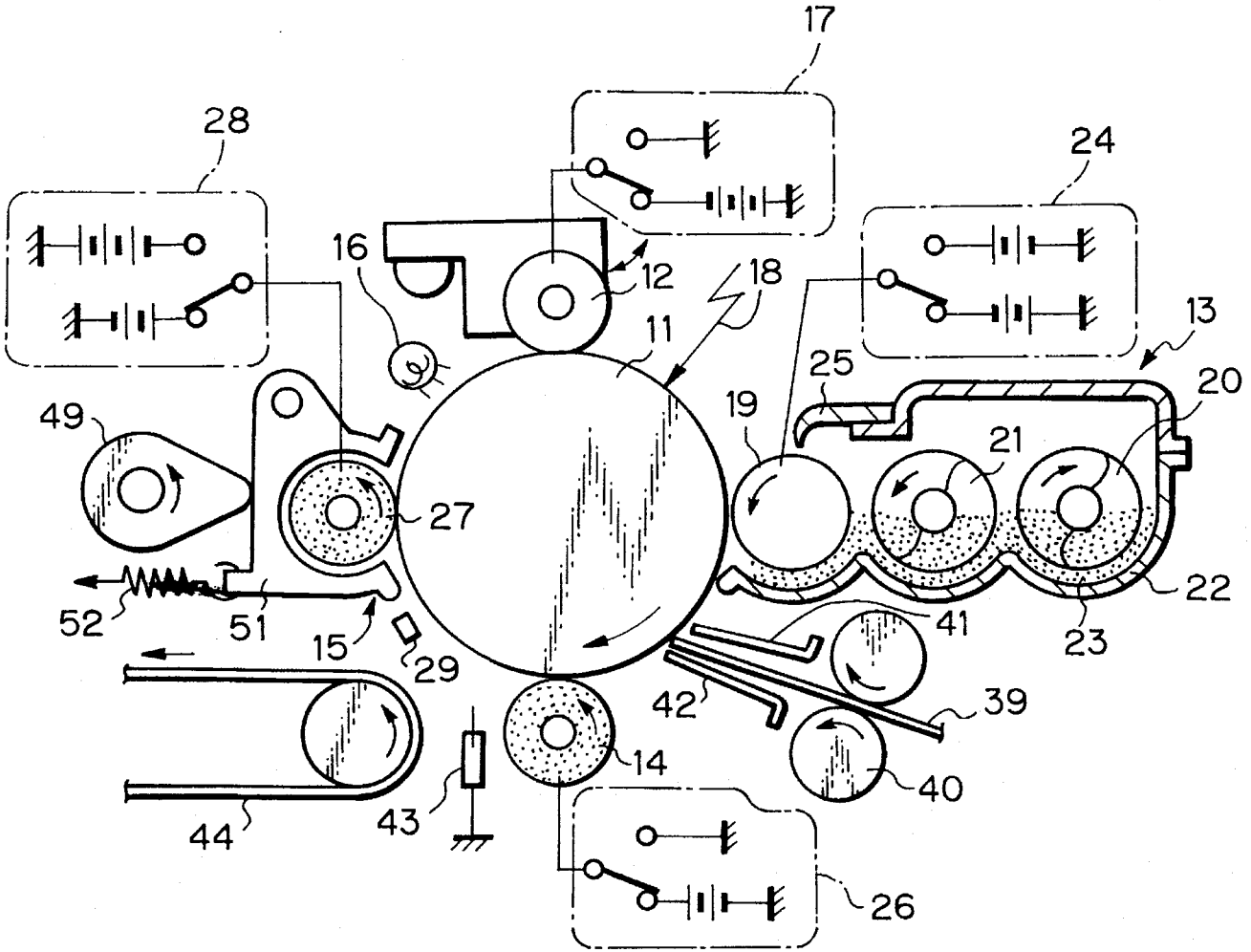
FIG. 1 is a section showing an image forming apparatus embodying the present invention.

Referring to FIG. 1 of the drawings, an electrophotographic image forming apparatus embodying the present invention is shown. As shown, the apparatus has an image carrier in the form of a photoconductive drum 11. Arranged around the drum 11 are a charge roller or charging means 12, laser optics or exposing means, not shown, a developing unit or developing means 13, a transfer roller or image transferring means 14, a cleaning unit or cleaning means 15, and a discharge lamp or optical discharging means 16. The drum 11 is rotated at a constant speed by a main motor or drive source, not shown. The bias power source 17 applies a preselected bias voltage to the charge roller 12.

The laser optics includes a semiconductor laser or light source. The laser is driven by a laser driver in accordance with an image signal. As a result, the laser emits a laser beam 18 modulated in accordance with the image signal. The beam 18 repeatedly scans the drum 11 in the axial direction of the drum 11 by being steered by a polygonal mirror rotating at a high speed. The surface of the drum 11 is moved at an extremely low speed, compared to the scanning rate of the polygonal mirror, so that the beam 18 scans the entire surface of the drum 11.

In the developing unit 13, a developing sleeve 19 and agitating members implemented as screws 20 and 21 are rotated by a drive source, not shown. The screws 20 and 21 agitate a two-ingredient type developer, i.e., a toner and carrier mixture 23 existing in a casing 22, while feeding it to the sleeve 19. The toner contained in the developer is charged to the negative polarity in contact with the carrier or by friction. The sleeve 19 holds the developer 23 with magnets disposed therein and conveys it while in rotation. A bias power source 24 applies a bias voltage of −600 V for development to the sleeve 19. A doctor 25 regulates the amount of the developer (magnet brush) to deposit on the sleeve 19. When the sleeve 19 brings the developer to a developing position where it faces the drum 11, the toner is transferred to the drum 11 so as to develop a latent image electrostatically formed on the drum 11. The developer left on the sleeve 19 after the above development is collected in the casing 22 and reused.

A bias power source 26 applies a preselected bias voltage for image transfer to the transfer roller 14. The cleaning unit 15 is selectively moved into or out of contact with the drum 11 by a moving mechanism which will be described. The cleaning unit 15 has a cleaning roller 27. A cleaning bias power source or bias applying means 28 applies a bias for cleaning to the cleaning roller 27. The surface of the cleaning roller 27 is made of a material which charges the toner to the same polarity as the charging polarity of the developing unit 13. A reflection density sensor or density sensing means 29 is interposed between the transfer roller 14 and the cleaning unit 15 in the vicinity of the drum 11. The sensor 29 is responsive to a reflection density from the toner image formed on the drum 11 by the developing unit 13.

Figure 2:
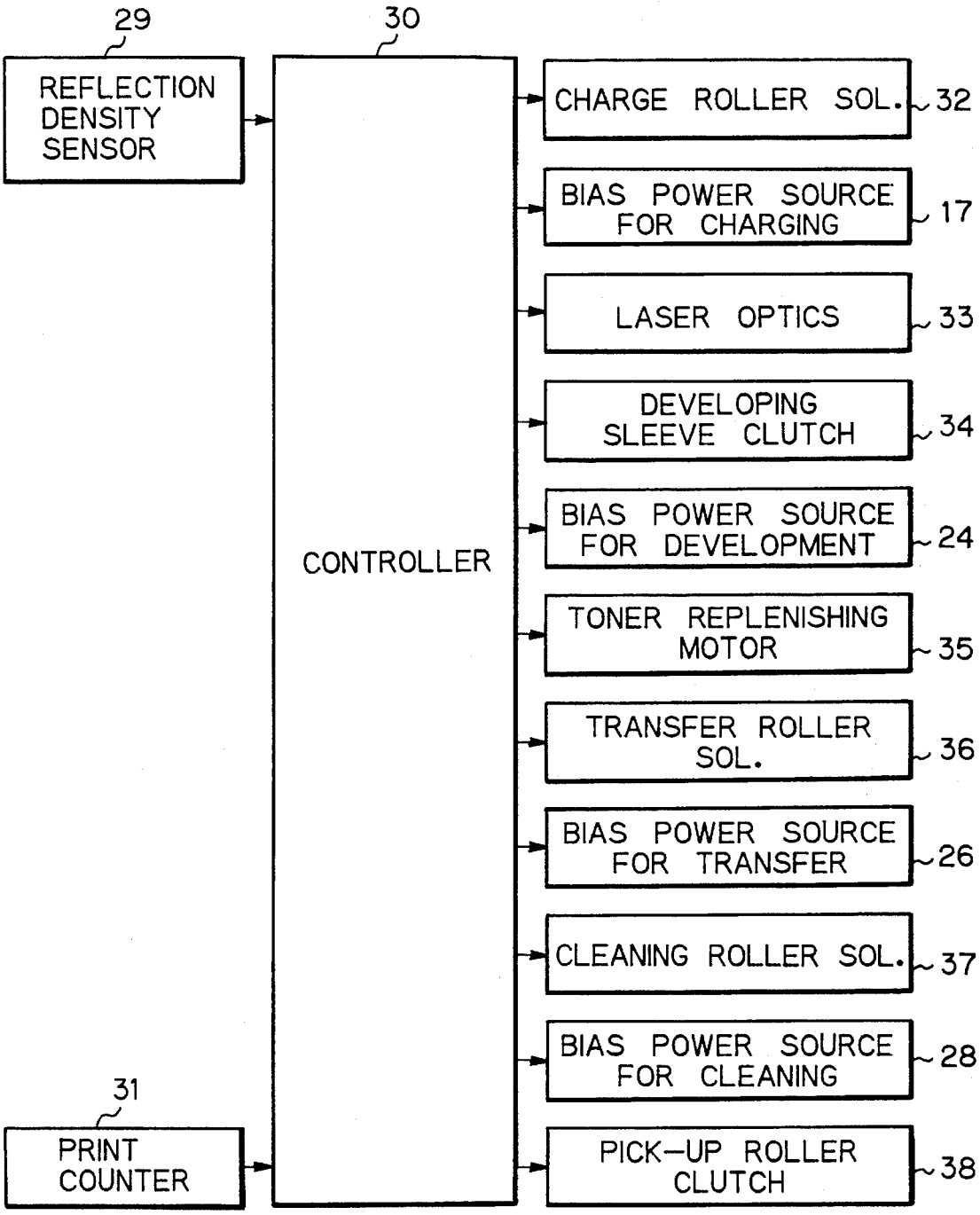
FIG. 2 is a block diagram schematically showing a control system included in the embodiment.

FIG. 2 shows a control system included in the illustrative embodiment. As shown, a controller 30 receives the output signal of the reflection density sensor 29 and the output of a print counter 31 as well as the output signals of other various sections including a start switch provided on an operation panel, not shown. In response, the controller 30 controls a charge roller solenoid 32, the charge bias power source 17, laser optics 33, a developing sleeve clutch 34, the development bias power source 24, a toner replenishing motor 35, a transfer roller solenoid 36, the transfer bias power source 26, a cleaning roller solenoid 37, the cleaning bias power source 28, a pick-up roller clutch 38, the main motor etc.

The print counter 31 counts hard copies produced in an image formation mode which will be described. The charge roller solenoid 32 actuates a mechanism for moving the charge roller 12 into and out of contact with the image carrier 11. The developing sleeve clutch 34 selectively couples or uncouples the developing sleeve 19 to or form a drive source. The toner replenishing motor 35 drives a toner replenishing section in which a toner bottle is removably set, so that a fresh toner is replenished from the bottle into the developing unit 13 as needed. The transfer roller solenoid 36 operates a mechanism for moving the transfer roller 14 into and out of contact with the image carrier 11. Likewise, the cleaning roller solenoid 37 operates a mechanism for selectively moving the cleaning roller 27 into or out of contact with the drum 11. The pick-up roller clutch 38 selectively couples or uncouples a pick-up roller included in a paper feed section, not shown, to or from a drive source.

The above apparatus is selectively operable in the above-mentioned image formation mode, a toner collection mode or a toner image sensing mode under a sequence control executed by the controller 30. In the image formation mode, a toner image is formed on the drum 11 in accordance with image data, then transferred to a paper or similar recording medium, and then fixed on the medium to complete a recording (hard copy). In the toner collection mode, the toner removed from the drum 11 by the cleaning unit 15 during the course of image formation is returned to the developing unit 13. In the toner image sensing mode, a solid toner image or a halftone toner image is formed in a part of the drum 11 as a reference toner image. The reflection density sensor 29 senses a reflection density from the reference toner image and representative of the toner concentration of the developer.

Figure 3A:
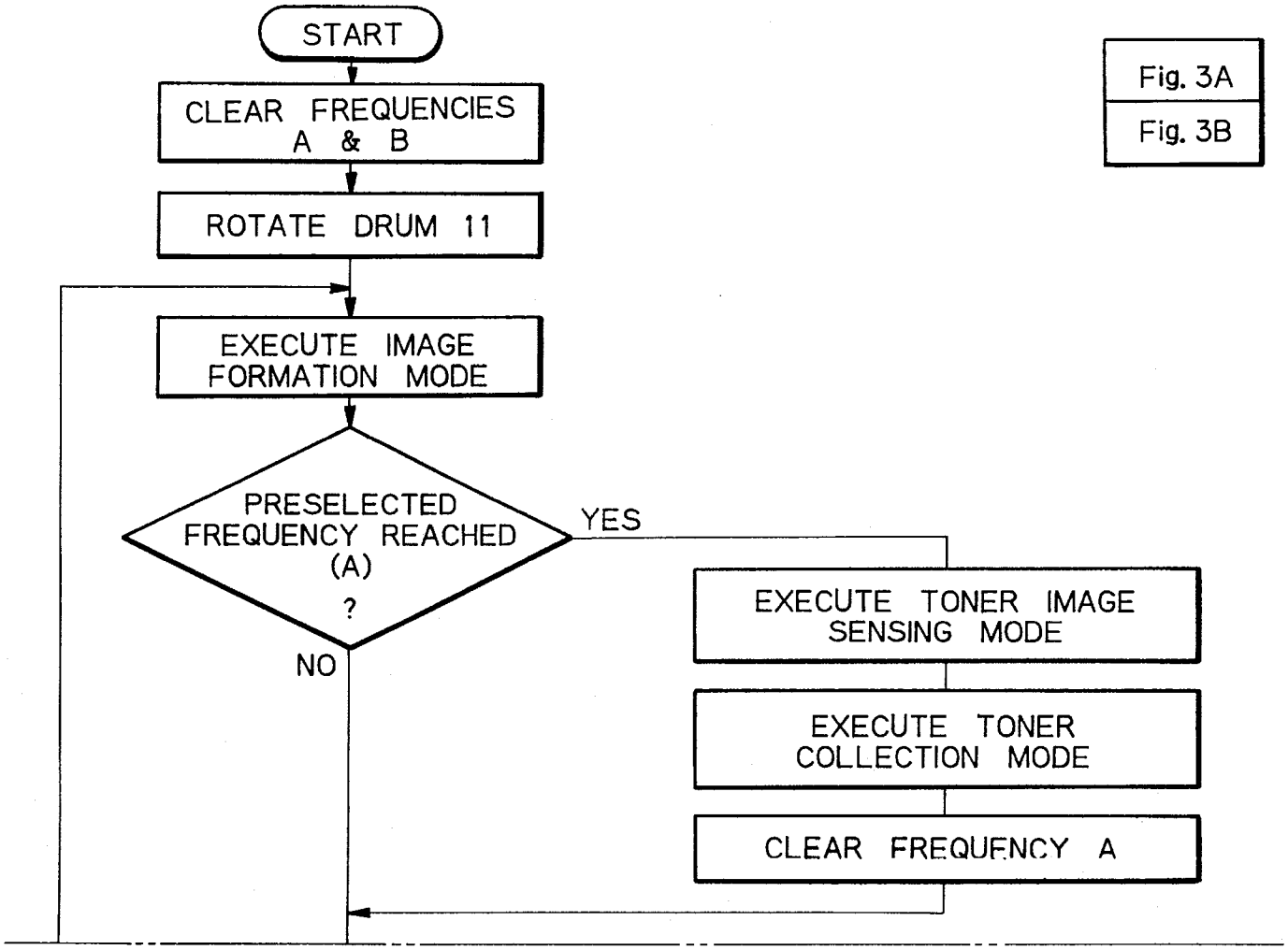
FIG. 3 is a flowchart demonstrating the general operation of the embodiment.
Figure 3B:
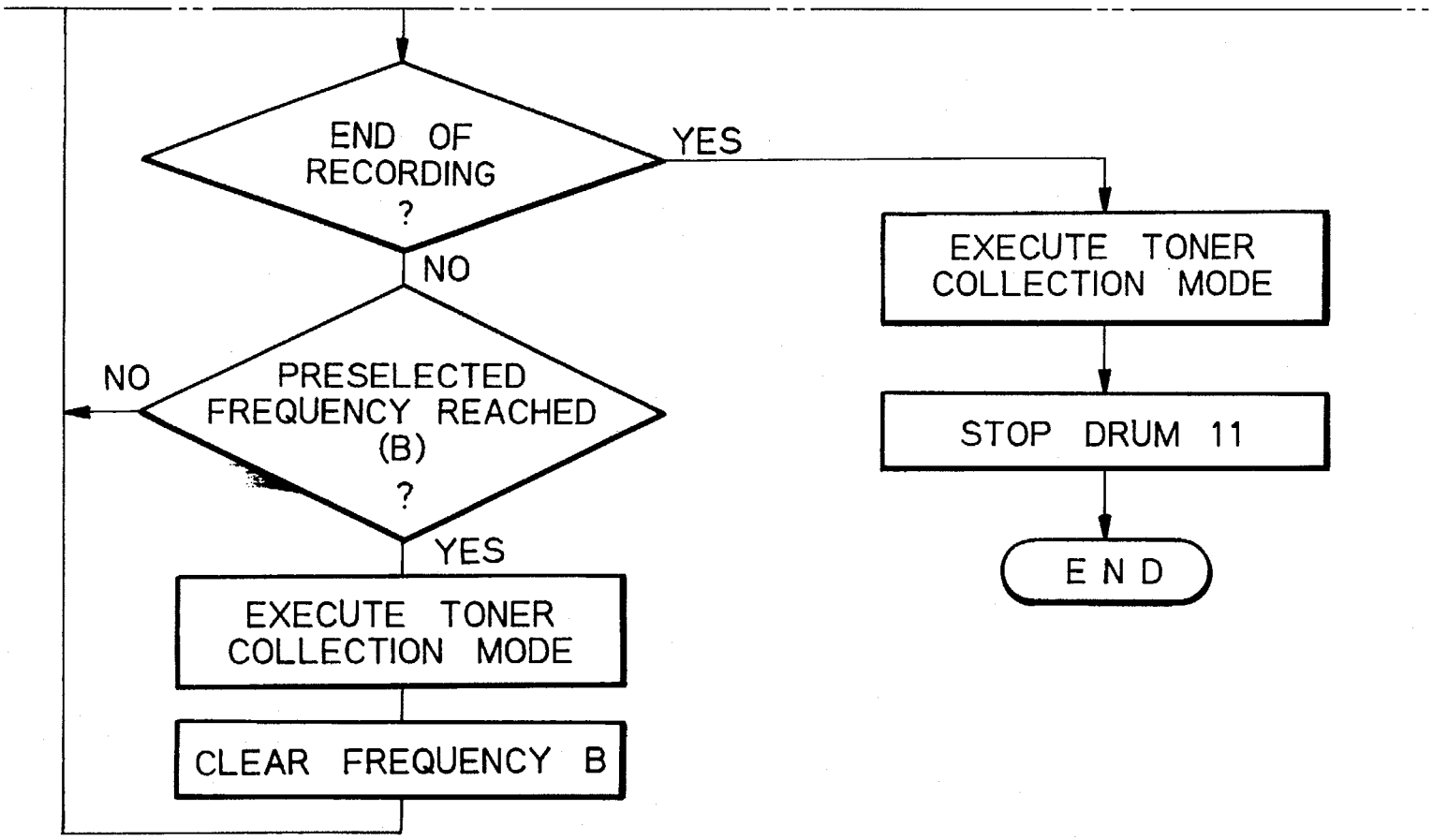

The general operation of the apparatus, i.e., controller 30 will be described with reference to FIG. 3. As shown, when the start switch provided on the operation panel is pressed, the controller 30 clears frequencies of execution A and B in response to the output of the start switch, and energizes the main motor for rotating the drum 11. In this condition, the controller 30 causes the image formation mode to be repeated a particular number of times corresponding to a desired number of recordings entered on the operation panel. The controller 30 counts the image formation modes continuously executed while storing the count, and determines whether or not the frequency of execution A has reached a preselected frequency, e.g., ten times. When the frequency of execution A has reached the preselected frequency, the controller 30 causes the toner image sensing mode to be executed. Subsequently, after the previously mentioned reference toner image has moved away from the cleaning roller 27, but before it reaches the developing unit 13, the controller 30 causes the toner collection mode to be started, and then clears the frequency A.

When the image formation mode is further repeated to continuously produce recordings, the controller 30 counts the image formation modes continuously executed while storing the count, and determines whether or not the frequency of execution B has reached a preselected frequency, e.g., five times. If the answer of this decision is positive, the controller 30 causes the toner collection mode to be executed, and then clears the frequency B. The controller 30 determines whether or not the image formation mode has been repeated the number of times corresponding to the desired number of recordings, i.e., whether or not the recording operation has ended. If the recording has ended, the controller 30 causes the toner collection mode to be executed, deenergizes the main motor to stop the rotation of the drum 11, and waits for the next recording operation.

Figure 4:
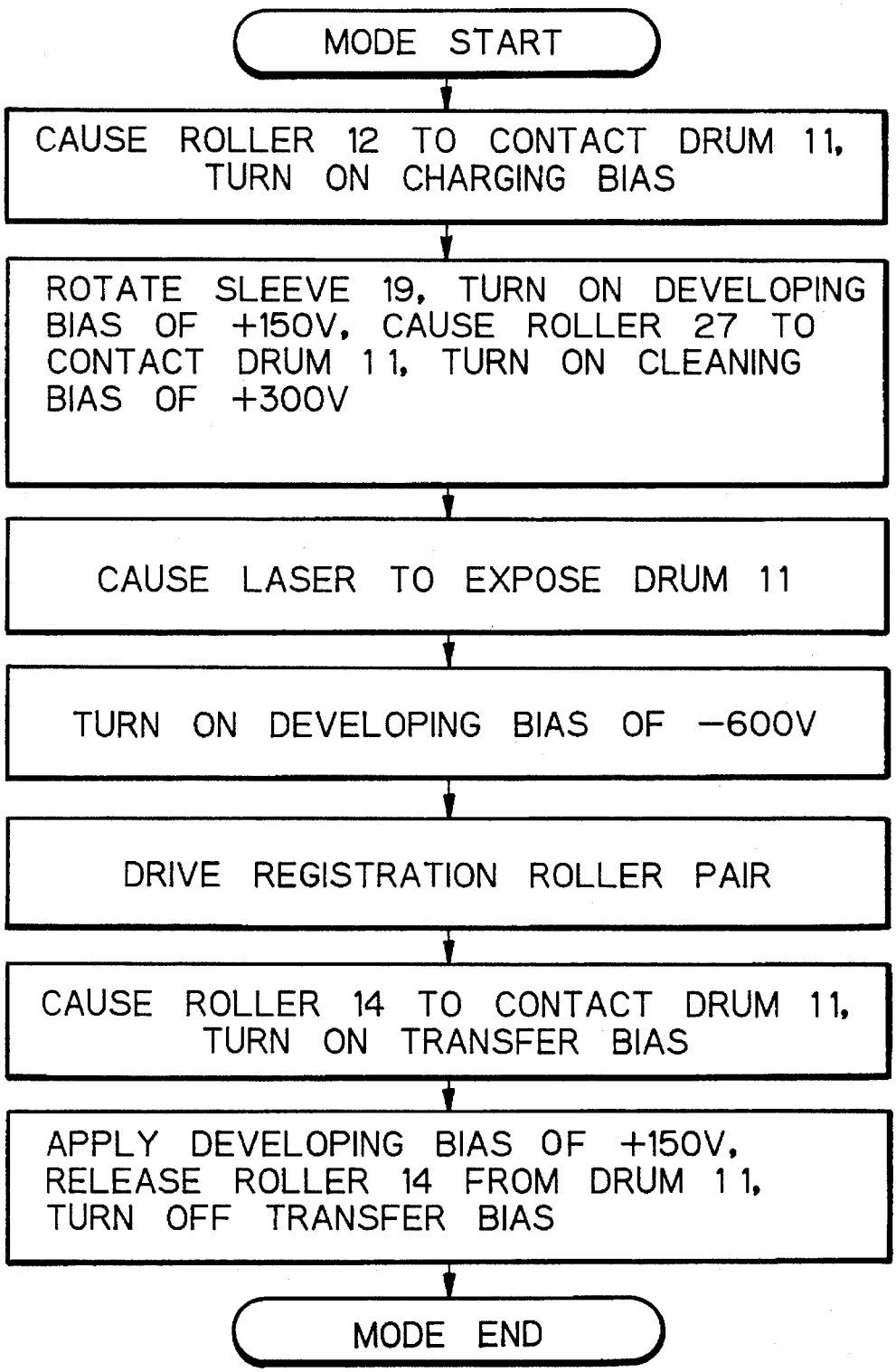
FIG. 4 is a flowchart representative of an image formation mode included in the routine shown in FIG. 3.

The individual mode available with the embodiment will be described more specifically hereinafter. It is to be noted that the embodiment executes the previously stated negative-to-positive process for image formation. As shown in FIG. 4, in the image formation mode, the controller 30 controls the various constituents of the apparatus so as to effect the following operations. The main motor drives the drum 11 at a constant speed. The solenoid 32 is turned on to bring the charge roller 12 into contact with the drum 11 via the exclusive mechanism. The bias power source 17 applies a bias voltage to the charge roller 12 with the result that the drum 11 is uniformly charged to the negative polarity (−850 V).

The clutch 34 is coupled to rotate the developing sleeve 19. The bias power source 24 applies a bias voltage of +150 V to the sleeve 19. The solenoid 37 is turned on to move the cleaning roller 27 into contact with the drum 11 via the exclusive mechanism. The bias power source 28 applies a bias of +300 V to the cleaning roller 27.

The laser 18 issuing from the laser optics 33 and modulated in accordance with image data scans the charged surface of the drum 11. As a result, a latent image (having a potential of −150 V at its black solid portion) is electrostatically formed on the drum 11. Specifically, the laser optics 33 scans the surface of the drum 11 with the laser beam 18 via the polygonal mirror rotating at a high speed. The power source 24 applies a bias of −600 V to the developing sleeve 19 of the developing unit 13. As a result, the magnet brush formed on the sleeve 19 develops the latent image carried on the drum 11 and thereby transforms it to a corresponding toner image.

When the clutch 38 is turned on, a recording medium implemented as a paper 39 is fed from the paper feed section to a registration roller pair 40. The roller 40 starts rotating in synchronism with the leading edge of the toner image formed on the drum 11, thereby driving the paper 39 to between the drum 11 and the transfer roller 14 along guides 41 and 42. At this instant, the solenoid 36 is turned on to bring the transfer roller 14 into contact with the drum 11 via the exclusive mechanism, and the bias power source 26 applies a bias voltage of +950 V to the roller 14. Consequently, the toner image is transferred from the drum 11 to the paper 39. Then, the paper 39 with the toner image is separated from the drum 11. A discharge needle or discharging means 43 dissipates the charge, or discharges, remaining on the paper 39. A belt 44 conveys the paper 39 to a fixing unit or fixing means, not shown. After the toner image has been fixed on the paper 39 by the fixing means, the paper 39 is driven out of the apparatus as a hard copy.

The bias power source 28 applies a bias of +300 V to the cleaning roller 27. The toner left on the drum 11 after the image transfer is brought into contact with the cleaning roller 27 and again charged to the negative polarity thereby. As a result, the toner is transferred from the drum 11 to the roller 27 by an electric field formed between the drum 11 and the roller 27. Subsequently, the bias voltage applied from the bias power source 24 to the developing sleeve 19 is switched from −600 V to +150 V. The solenoid 36 is turned off to move the transfer roller 14 away from the drum 11 via the exclusive mechanism. At the same time, the bias voltage from the bias power source 26 to the transfer roller 14 is interrupted.

Figure 5:
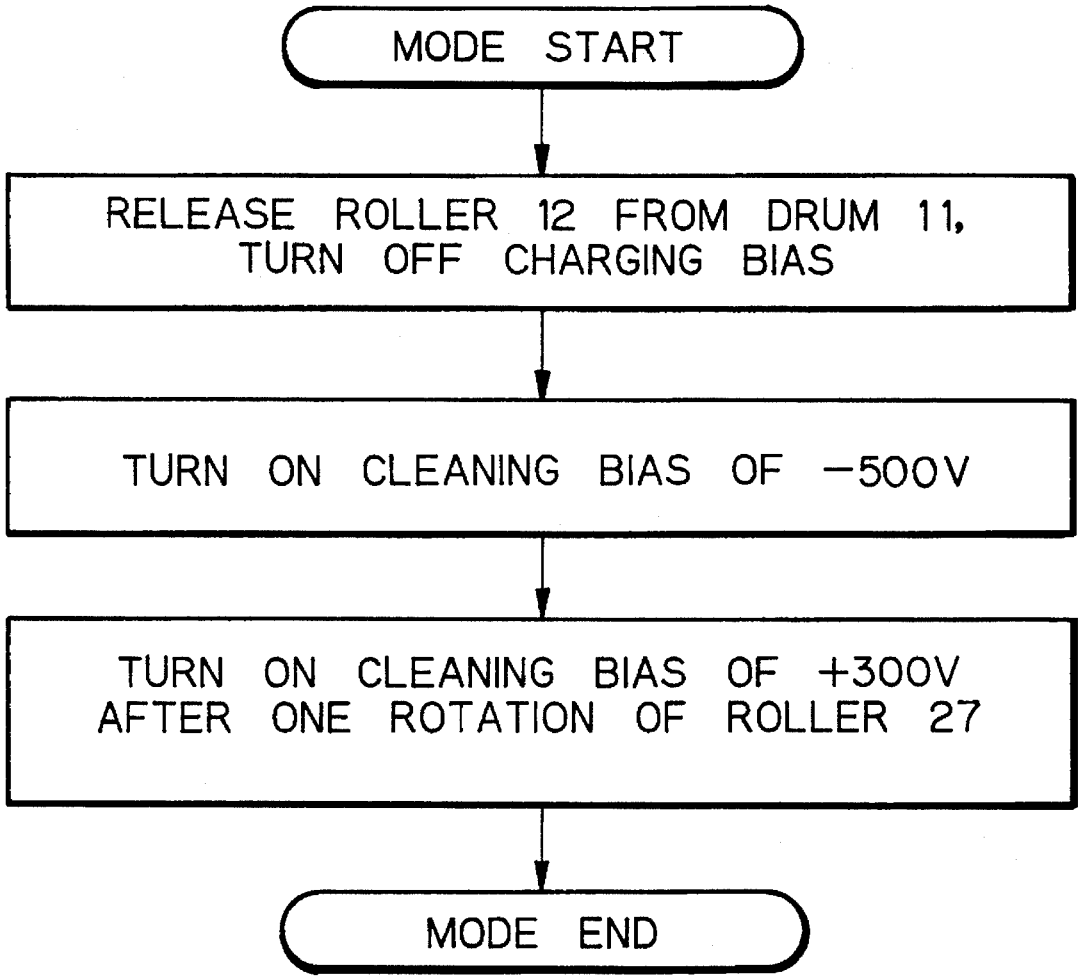
FIG. 5 is a flowchart representative of a toner collection mode also included in the routine of FIG. 3.

In the toner collection mode, the controller 30 controls the various sections of the apparatus so as to effect operations which will be described with reference to FIG. 5. As shown, the solenoid 32 is turned off to move the charge roller 12 away from the drum 11 via the exclusive mechanism. The bias power source 28 applies a bias of −500 V to the cleaning roller 27. As a result, the toner retained by the cleaning roller 27 and charged to the negative polarity is gains transferred to the drum 11. The drum 11 conveys this toner to the developing unit 13. After one rotation of the cleaner roller 27 after the cleaning bias of −500 V is applied, a cleaning bias of +300 V is turned on. Consequently, the toner is collected by the magnet brush of the sleeve 19 due to an electric field formed between the sleeve 19 and the drum 11.

Figure 6:
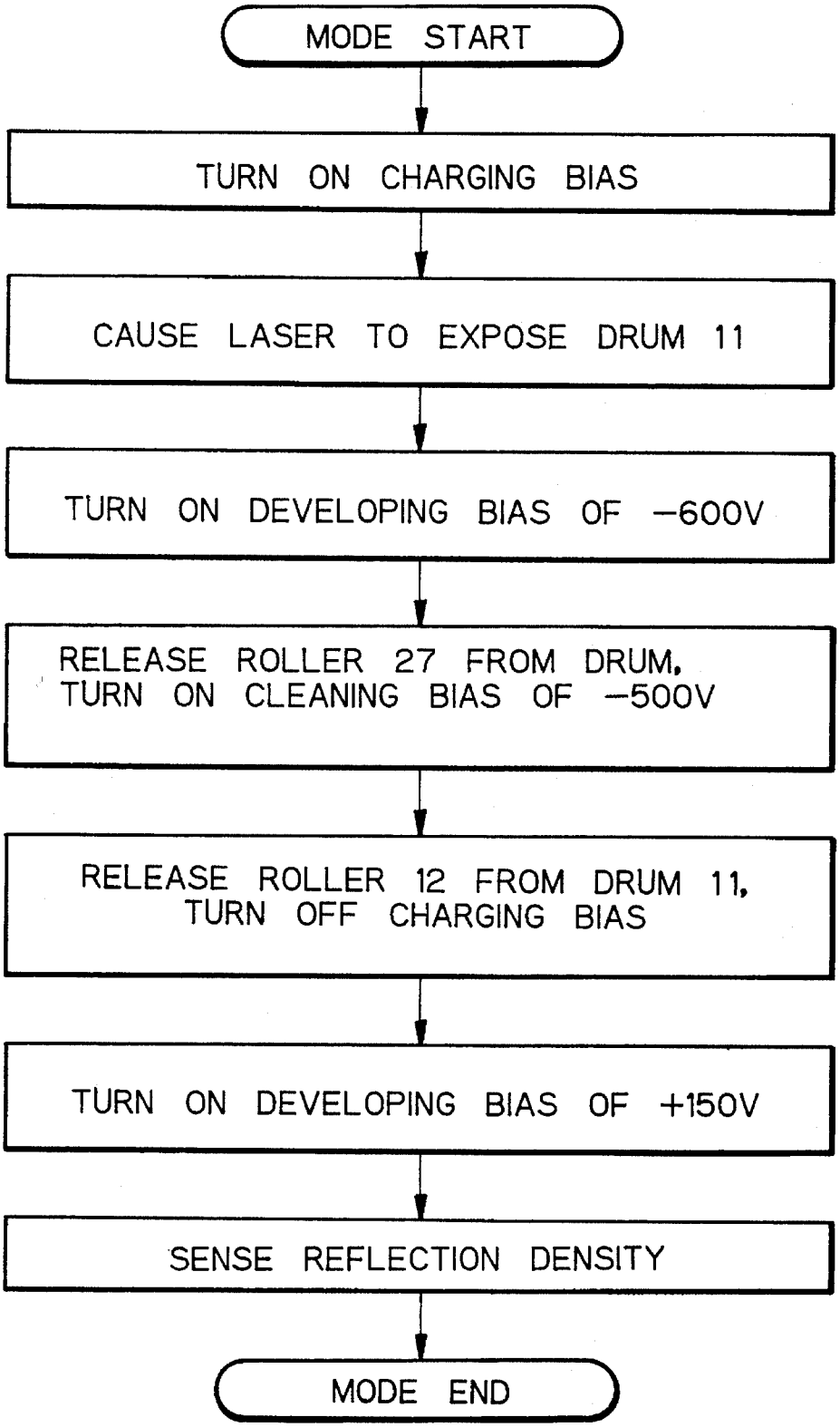
FIG. 6 is a flowchart representative of a toner image sensing mode further included in the routine of FIG. 3.

FIG. 6 demonstrates the toner image sensing mode. In this mode, the controller 30 controls the various constituents of the apparatus in such a manner as to effect the following operations. As shown, the bias power source 17 applies a bias voltage to the charge roller 12 so as to uniformly charge the drum 11 to the negative polarity. In this case, the laser beam 18 issuing from the laser optics 33 is modulated in accordance with image data representative of a reference pattern which is stored in the apparatus. The laser beam 18 scans the charged surface of the drum 11 to electrostatically form a latent image representative of the reference pattern (and having a potential of −150 V in its black solid portion).

The bias power source 24 applied a bias voltage of −600 V to the developing sleeve 19. As a result, the latent image representative of the reference pattern is developed by the developing unit 13 and turns out the reference toner image stated earlier. The transfer roller 14 is spaced from the drum 11 and held inoperative. The cleaning roller 27 is also spaced from the drum 11 by the solenoid 37 which is turned off. The bias power source 28 applies a bias of −500 V to the roller 27. Even when the reference toner image on the drum 11 arrives at a cleaning position assigned to the roller 27, it does not smear the roller 27 because the roller 27 is spaced from the drum 11 and because the electric field for causing the toner to fly away from the drum 11 is absent.

The solenoid 32 is turned off to bring the charge roller 12 out of contact with the drum 11 while the bias voltage from the bias power source 17 to the roller 12 is interrupted. The bias voltage applied form the bias power source 24 to the developing sleeve 19 is switched to +150 V. The reflection density sensor 29 optically senses a reflection density from the reference toner image carried on the drum 11, and sends its output to the controller 30. In response, the controller 30 causes the fresh toner to be replenished from the toner replenishing section into the developing unit 13, as needed.

The transfer roller 14 is spaced from the drum 11 when image transfer is not effected, but it is brought into contact with the drum 11 when image transfer is effected. Hence, in the toner image sensing mode, the roller 14 is spaced from the drum 11 and held inoperative.

By executing the sequence control described with reference to FIG. 2, the controller 30 allows the sequence of image formation, toner collection and toner density sensing to be efficiently effected. The cleaning roller 27 is capable of holding a certain amount of toner thereon during the course of repeated image formation mode. Hence, only if the toner is reversely transferred from the roller 27 to the drum 11 once for a preselected number of times of image formation, the roller 27 is free from the adverse influence of the accumulation of the toner. When a great number of recordings should be continuously produced, the toner collection mode is executed at an adequate timing so as to achieve both the maintenance of high image quality and the enhancement of efficient operation. Further, because the toner concentration in the developing unit 13 does not sharply change, both the recovery of image quality and the efficient operation are achievable only if the toner image sensing mode is executed once for a preselected number of times of image formation.

In the toner image sensing mode, the transfer roller 14 and cleaning roller 27 are spaced from the drum 11. This prevents the reference toner image from smearing the transfer roller 14 and cleaning roller 27 and allows the toner collection mode to be started immediately after the reference toner image has moved away from the cleaning position. The surface of the roller 27 (portion to contact the toner) is made of a material which charges the toner to the negative polarity (original polarity). Hence, in the toner collection mode, the toner can be directly collected by the magnet brush of the developing sleeve 19.

Figure 7:
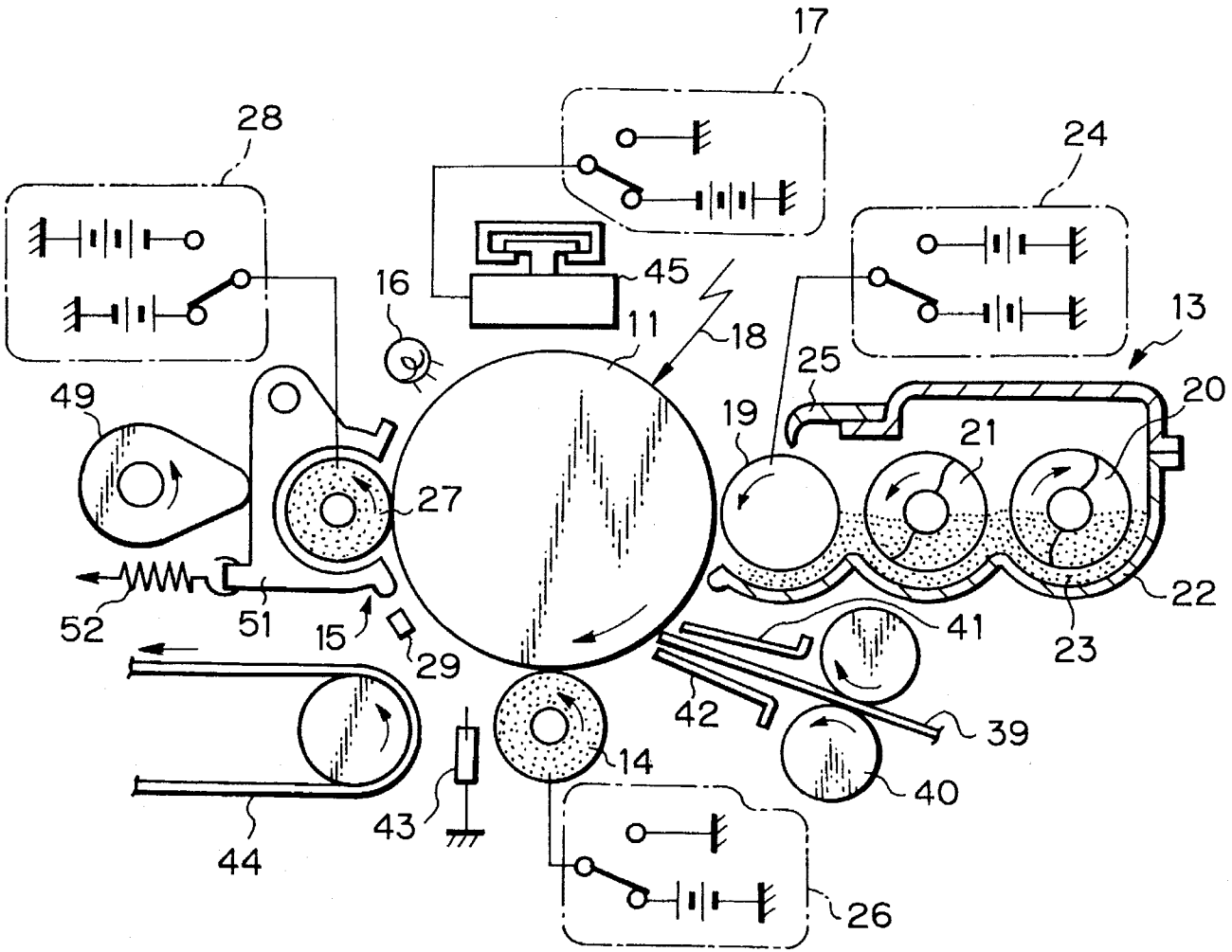
FIG. 7 is a section showing an alternative embodiment of the present invention.

FIG. 7 shows an alternative embodiment of the present invention. As shown, the alternative embodiment is identical with the previous embodiment except that non-contact type charging means 45 using corona or needle electrode is substituted for the charge roller 12. In the alternative embodiment, the mechanism for moving the charging means into and out of contact with the drum 11 is not necessary. In the two embodiments, the controller 30 is assumed to control the replenishment of the toner from the toner replenishing section into the developing unit 13 in response to the output of the reflection density sensor 29. Alternatively, the controller 30 may control developing conditions in response to the output of the sensor 29.

A reference will be made to FIG. 8 for describing a specific configuration of the mechanism for moving the cleaning roller 27 into and out of contact with the drum 11 and included in the above embodiments. Assume that the mechanism is rotated 180 degrees from the position shown in FIG. 8 to a position where the roller 27 is spaced from the drum 11. Then, when the solenoid 37 is turned on, a plunger **37*a* extending from the solenoid 37 pulls a one-direction clutch lever 46 until a locking portion 46*a* included in the lever 46 has been released from a one-direction clutch 47. As a result, the clutch 47 is rendered rotatable in a direction indicated by an arrow in FIG. 8. In this condition, a torque is transferred from a driveline, not shown, to the clutch 47, so that the clutch 47** starts rotating.

On the elapse of a preselected period of time, the solenoid 37 is turned off with the result that the locking portion 46*a* of the clutch lever 46 abuts against the drum portion of the clutch 47. Two spaced lugs are provided on the drum portion of the clutch 47. The locking portion 46*a* catches one of the two lugs and thereby stops the rotation of the clutch 47. At this instant, a front cam 49 and a rear cam 50 mounted on a cam shaft 48 integrally with the clutch 47 are brought to a stop in the condition shown in FIG. 8. The front cam 49 urges the front portion of a cleaning casing 51 toward the drum 11 against the action of a front spring 52. The front spring 52 is anchored to the front portion of the cleaning casing 51 and has biased the casing 51 away from the drum 11.

The front portion of the cleaning roller 27 is rotatably supported by a bearing 53 which is mounted on the cleaning casing 51 in such a manner as to be slidable relative to the casing 51. A front spring 54 constantly biases the front portion of the roller 27 toward the drum 11. Hence, when the front portion of the casing 51 is urged toward the drum 11 by the cam 49, it is pressed against the drum 11 by a preselected pressure.

Likewise, the rear portion of the casing 51 having been biased away from the drum 11 by a rear spring, not visible, similar to the front spring 52 is urged toward the drum 11 by the rear cam 50. The rear portion of the roller 27 is rotatably supported by a bearing, not visible, which is mounted on the casing 51 in such a manner as to be slidable relative to the casing 51. A spring, not visible, similar to the spring 54 constantly biases the rear portion of the roller 27 toward the drum 11. Hence, when the rear portion of the casing 51 is urged toward the drum 11 by the rear cam 50, it is pressed against the drum 11 by a preselected pressure.

Figure 8:
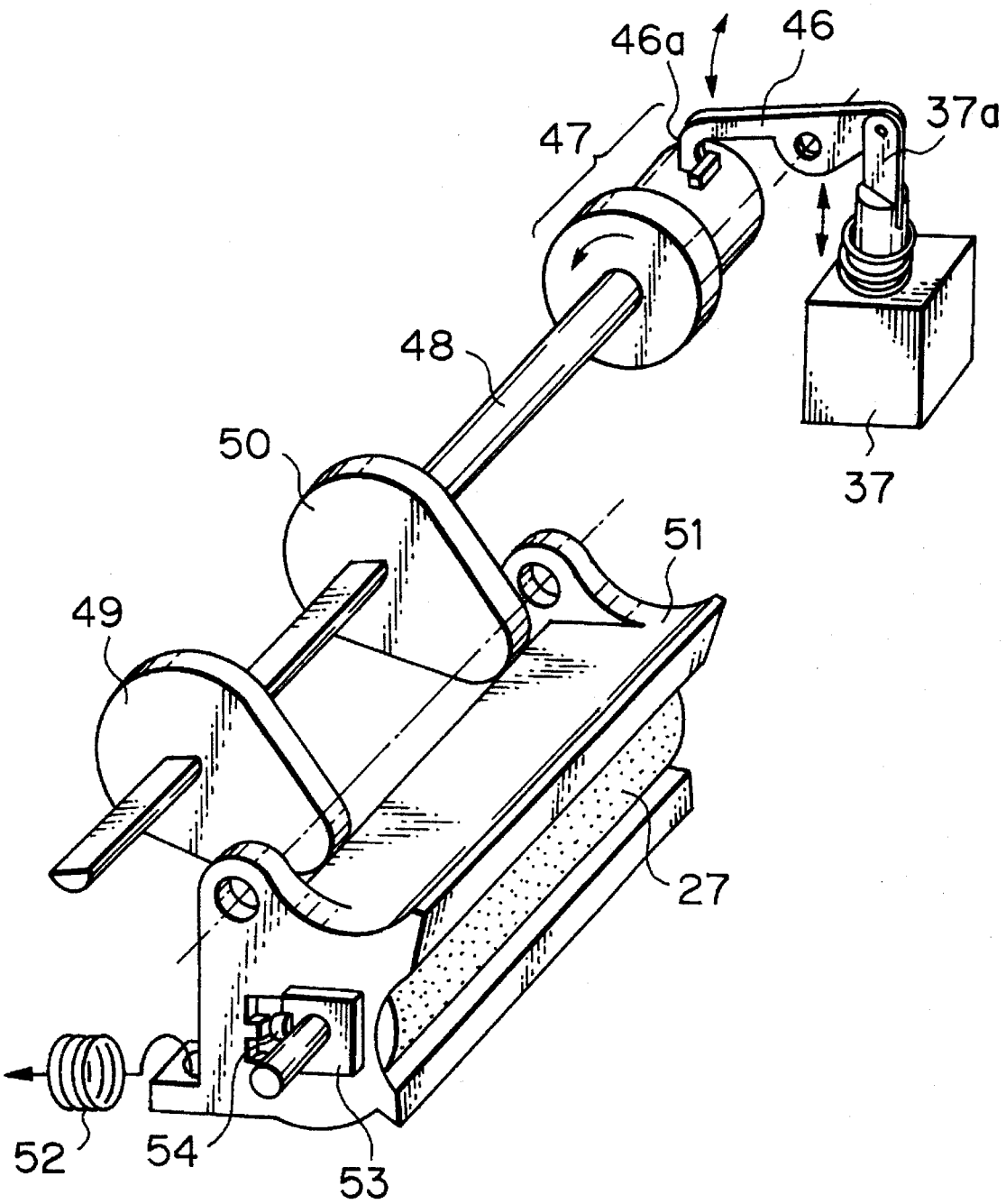
FIG. 8 is a perspective view showing a specific configuration of a mechanism for moving a cleaning roller into and out of contact with an image carrier, and applicable to the embodiments shown in FIGS. 1 and 7.

To release the roller 27 from the drum 11, the solenoid 37 and clutch 47 are so operated as to rotate the front cam 49 and rear cam 50 180 degrees from the position shown in FIG. 8. As a result, the roller 27 is released from the drum 11 by the front spring 52 and rear spring similar thereto.

As stated above, in the embodiments shown and described, a system operable in different modes on a function basis is achieved and allows the developing means to collect the toner efficiently with a minimum of mechanical movement. Therefore, there can be surely and efficiently effected the removal of the toner from the drum 11 after image transfer and the collection of the removed toner and the toner forming the reference toner image by the developing means.

Further, in the image formation mode, the toner left on the drum 11 after image transfer can have its polarity restored to the original polarity before it is collected by the cleaning means. In the toner image sensing mode, the image transferring means and cleaning means are free from contamination ascribable to the reference image. When the reference image is returned to the developing means, it is surely collected by the developing means.

Figure 9:
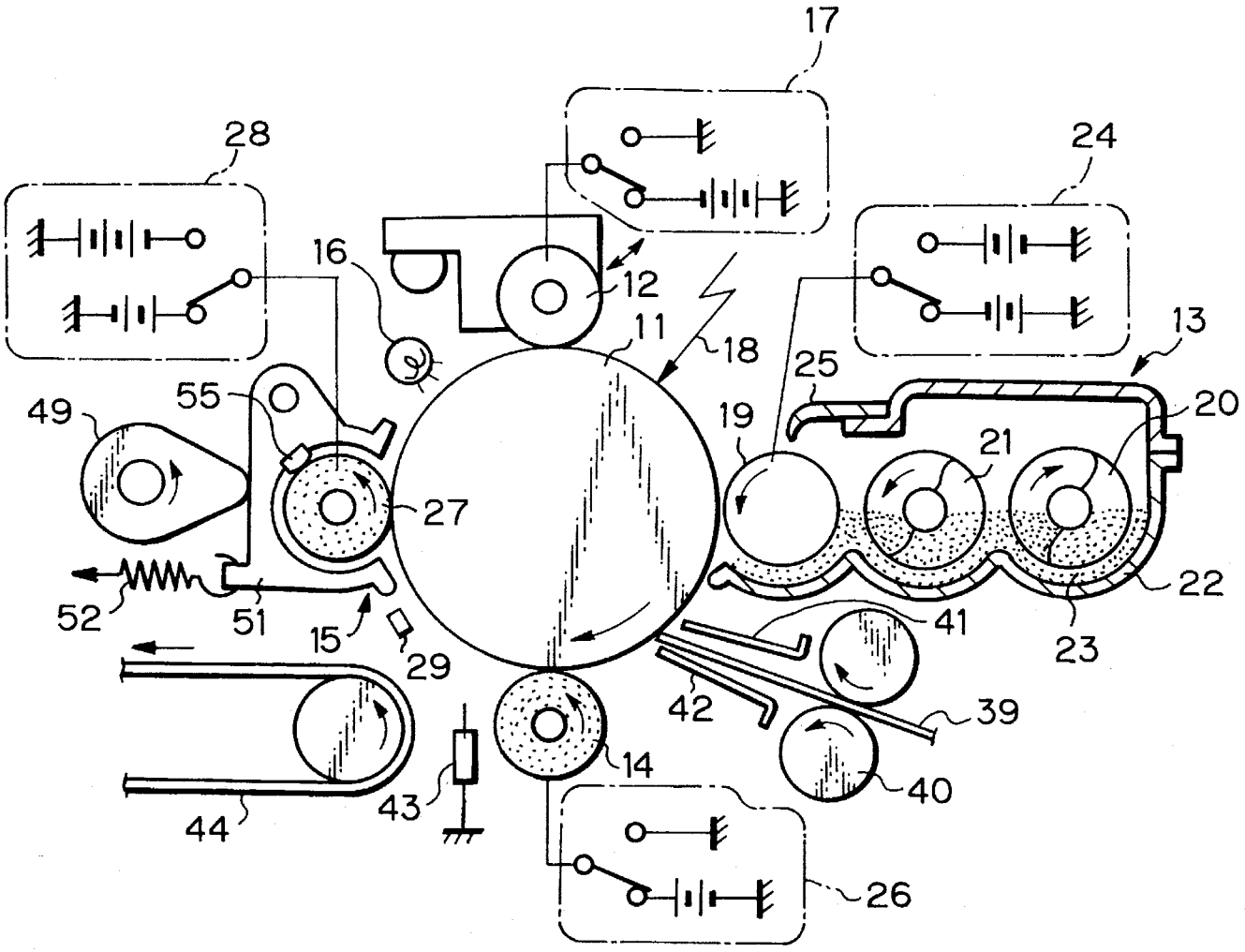
FIG. 9 is a section showing another alternative embodiment of the present invention.

Another alternative embodiment of the present invention will be described with reference to FIG. 9. Because this embodiment is similar to the embodiment shown in FIG. 1, the following description will concentrate on differences between the former and latter. As shown, a reflection density sensor 55 is located in the vicinity of the cleaning roller 27. The sensor 55 optically senses the contamination of the cleaning roller 27 and sends its output to the controller 30.

Figure 10A:
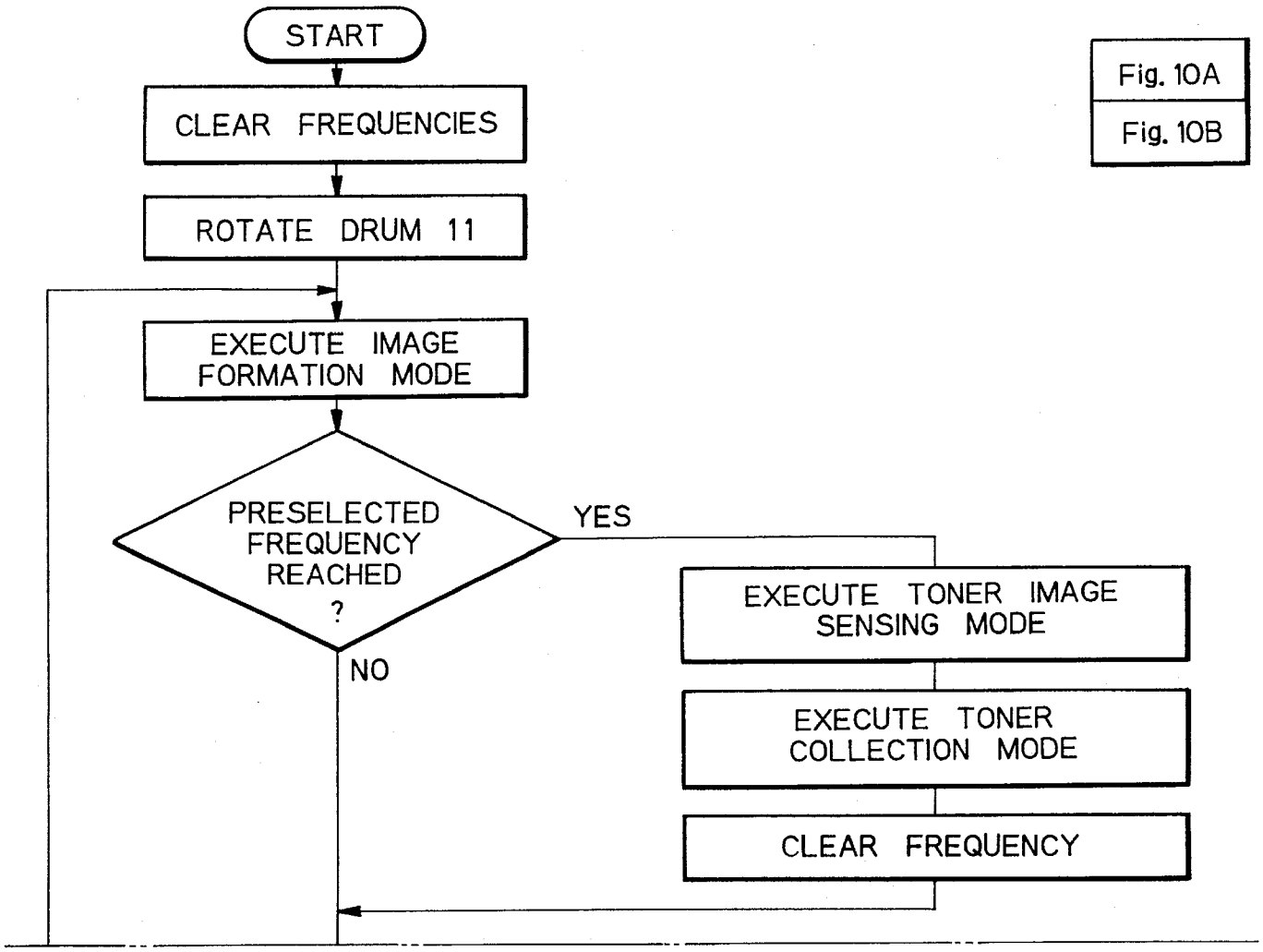
FIG. 10 is a flowchart demonstrating the general operation of the embodiment shown in FIG. 9.
Figure 10B:
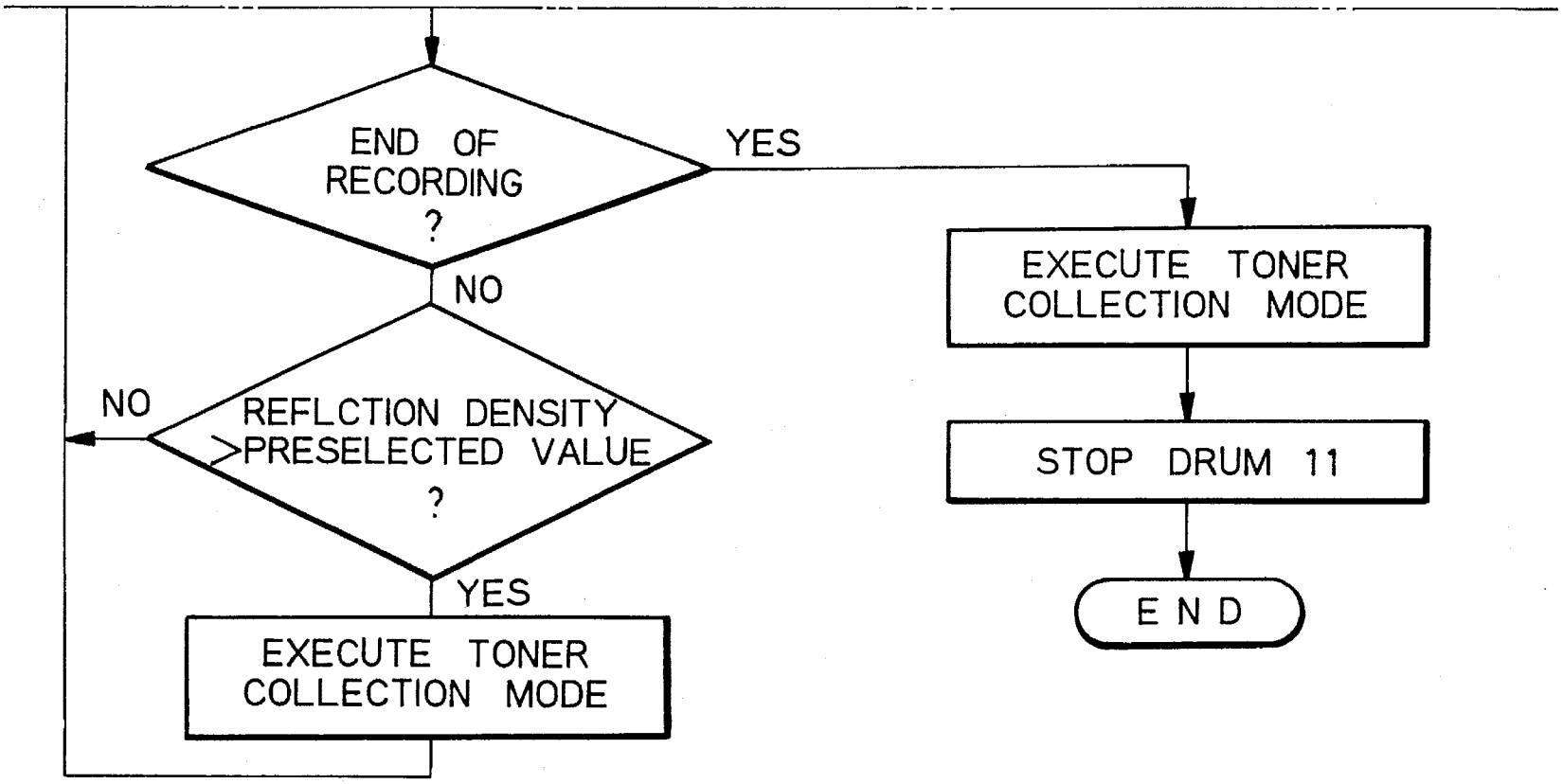

FIG. 10 demonstrates the general operation of the above embodiment. As shown, when the start switch provided on the operation panel is pressed, the controller 30 clears the frequency of execution of the individual mode in response to the output of the start switch, and energizes the main motor for rotating the drum 11. In this condition, the controller 30 causes the image formation mode to be repeated a particular number of times corresponding to a desired number of recordings entered on the operation panel.

The controller 30 counts the individual mode continuously repeated while storing the count, and determines whether or not the image formation mode has been repeated a preselected number of times. If the answer of this decision is positive, the controller 30 causes the toner image sensing mode to be executed. Subsequently, after the reference toner image has moved away from the cleaning roller 27, but before it reaches the developing unit 13, the controller 30 causes the toner collection mode to be started, and then clears the frequency of the image formation mode.

Further, every time the image formation mode is executed, the controller 30 reads the output signal of the reflection density sensor or density sensing means 55 to see if the actual reflection density of the cleaning roller 27 is higher than a preselected reference density. If the actual density is higher than the reference density, the controller 30 causes the toner collection mode to be effected. When the controller 30 determines that the recording operation has ended, i.e., the image formation mode has been repeated the number of times corresponding to the desired number of recordings, it causes the toner collection mode to be executed, deenergizes the main motor which drives the drum 11, and waits for the next image formation mode.

By executing the above sequence control, the controller 30 allows the sequence of image formation, toner collection and toner density sensing to be efficiently achieved. In the image formation mode, the toner can be reversely transferred from the cleaning roller 27 to the drum 11 when the output signal of the sensor 55 responsive to the contamination of the roller 27 indicates the need for the reverse transfer. Hence, both the maintenance of image quality and the enhancement of efficient operation are achievable at the same time. In addition, because the toner concentration in the developing unit 13 does not sharply change, both the recovery of image quality and the efficient operation are achievable only if the toner image sensing mode is executed once for a preselected number of times of image formation.

Moreover, the above embodiment sequentially executes the image formation mode, toner image sensing mode and toner collection mode in this order while determining whether or not they are necessary. Both the reference toner image and the toner left after image transfer can be removed from the drum 11 and collected by the developing means. Consequently, the removal of the remaining toner from the drum 11 and the collection of the removed toner and reference toner image by the developing means are surely and efficiently effected.

Still another alternative embodiment is similar to the embodiment of FIG. 1 except for the following. In the alternative embodiment, the cleaning roller 27 is held in contact with the drum 11 without regard to the mode. The bias power source 28 applies, under the control of the controller 30, a bias voltage of +300 V to the cleaning roller 27 in the image formation mode or a bias voltage of −500 V in the toner image sensing mode and toner collection mode.

In the above condition, the reference toner image formed on the drum 11 is caused to contact the cleaning roller 27. However, because the toner is charged to the negative polarity, it moves away from the roller 27 which is also biased to the negative polarity. In this configuration, the mechanism for moving the roller 27 into and out of contact with the drum 11 is not necessary.

This embodiment can restore the polarity of the toner left on the drum 11 in the image formation mode and then collect it with the cleaning means. In the toner image sensing mode, the polarity of the reference toner image is not inverted by the image transferring means, so that the image transferring means and cleaning means are free from contamination ascribable to the reference image. When the reference toner image is returned to the developing means, it can be immediately collected by the developing means.

A further alternative embodiment is similar to the embodiment of FIG. 1 except for the following. In this embodiment, the bias power source 28 applies a bias voltage of −500 V to the cleaning roller 27 without regard to the mode. The controller 30 controls the various sections of the embodiment so as to effect the following operations. In the toner image sensing mode, when the reference image passes through the cleaning position of the roller 27, the solenoid 37 is turned off to move the roller 27 away from the drum 11.

In the image formation mode, the toner left on the drum 11 after image transfer is charged to the positive polarity by the transfer roller 14 and electrically attracted by the cleaning roller 27 which is biased. The toner deposited on the roller 27 is again charged to the negative polarity in contact with the roller 27 or by friction. In the toner collection mode, the toner of negative polarity is transferred from the roller 27 to the drum 11 due to the bias voltage applied to the roller 27. In the toner image sensing mode, the reference toner image of negative polarity remains on the drum 11 because it moves through the cleaning position of the roller 27.

In the image formation mode, ti may occur that some toner is reversely transferred from the cleaning roller 27 to the drum 11 because the toner deposited on the roller 27 changes in polarity. However, because the reversely transferred toner is electrically repulsed by the charge roller 12, it is successfully moved away from the charge roller 12 and collected by the magnet brush of the developing sleeve 19. In addition, because the amount of this part of the toner is small, it does not bring about any problem in practice, e.g., the contamination of the roller 12 or the incomplete collection by the sleeve 19.

In the toner image sensing mode, an electric field which dissipates the toner of the reference image is formed between the cleaning means and the image carrier. This frees the cleaning means from contamination ascribable to the reference toner image. As soon as the reference toner image is returned to the developing means, it is collected by the developing means.

Again, in the embodiments shown and described, the controller 30 may control, in response to the output of the sensor 29, developing conditions in place of the replenishment of fresh toner into the developing unit 13.

In summary, it will be seen that the present invention provides an image forming apparatus having various unprecedented advantages, as enumerated below.

(1) A system operable in different modes on a function basis is achieved and allows developing means to collect toner efficiently with a minimum of mechanical movement. Therefore, there can be surely and efficiently effected the removal of toner from an image carrier after image transfer and the collection of the removed toner and toner forming a reference toner image by the developing means.

(2) The apparatus sequentially executes an image formation mode, toner image sensing mode and toner collection mode in this order while determining whether or not they are necessary. Both the reference toner image and the toner left after image transfer can be removed from the image carrier and collected by the developing means. Consequently, the removal of the remaining toner from the image carrier and the collection of the removed toner and reference toner image by the developing means are surely and efficiently effected.

(3) The apparatus can restore the polarity of the toner left on the image carrier in the image formation mode and then collect it with the cleaning means. In the toner image sensing mode, image transferring means and cleaning means are free from contamination ascribable to the reference toner image. When the reference toner image is returned to the developing means, it can be immediately collected by the developing means.

(4) The apparatus can restore the polarity of the toner left on the image carrier in the image formation mode and then collect it with the cleaning means. In the toner image sensing mode, the polarity of the reference toner image is not inverted by the image transferring means, so that the image transferring means and cleaning means are free from contamination ascribable to the reference image. When the reference toner image is returned to the developing means, it can be immediately collected by the developing means.

(5) In the toner image sensing mode, an electric field which dissipates the toner of the reference image is formed between the cleaning means and the image carrier. This frees the cleaning means from contamination ascribable to the reference toner image. As soon as the reference toner image is returned to the developing means, it is collected by the developing means.

Various modifications will become possible for those skilled in the art after receiving the teachings of the present disclosure without departing from the scope thereof.

What is claimed is:

1. In an image forming apparatus selectively operable in any one of an image formation mode for uniformly charging a photoconductive image carrier by charging means, optically exposing said image carrier to thereby electrostatically form a latent image, developing the latent image by developing means storing a toner and carrier mixture to thereby form a corresponding toner image, transferring the toner image to a recording medium by image transferring means, electrically collecting the toner left on the recording medium by cleaning means, and fixing the toner image transferred to the recording medium by fixing means; a toner collection mode for transferring the toner from said cleaning means to said image carrier, and collecting the toner in said developing means; and a toner image sensing mode for forming a reference toner image on said image carrier, sensing a reflection density from the reference toner image by density sensing means, and operating, based on an output of said density sensing means, toner replenishing means for replenishing a fresh toner to said developing means, or setting a developing condition matching the output of said density sensing means;

said toner collection mode is executed when a series of image formation modes ends and every time said image formation mode is continuously repeated a preselected number of times, while said toner image sensing mode is executed every time said image formation mode is repeated a preselected number of times.

2. In an image forming apparatus selectively operable in any one of an image formation mode for uniformly charging a photoconductive image carrier by charging means, optically exposing said image carrier to thereby electrostatically form a latent image, developing the latent image by developing means storing a toner and carrier mixture to thereby form a corresponding toner image, transferring the toner image to a recording medium by image transferring means, electrically collecting the toner left on the recording medium by cleaning means, and fixing the toner image transferred to the recording medium by fixing means; a toner collection mode for transferring the toner from said cleaning means to said image carrier, and collecting the toner in said developing means; and a toner image sensing mode for forming a reference toner image on said image carrier, sensing a reflection density from the reference toner image by density sensing means, and operating, based on an output of said density sensing means, toner replenishing means for replenishing fresh toner to said developing means, or setting a developing condition matching the output of said density sensing means;

there are executed a series of steps of determining, after said image formation mode, whether or not said toner image sensing mode is necessary, executing, if said toner image sensing mode is necessary, said toner collection mode after said toner image sensing mode, determining, if said toner image sensing means is not necessary, whether or not said toner collection mode is necessary, executing said toner collection mode if said toner collection mode is necessary, and setting up a stand-by state for awaiting said image formation mode.

3. An image forming apparatus selectively operable in any one of an image formation mode for uniformly charging a photoconductive image carrier by charging means, optically exposing said image carrier to thereby electrostatically form a latent image, developing the latent image by developing means storing a toner and carrier mixture to thereby form a corresponding toner image, transferring the toner image to a recording medium by image transferring means, electrically collecting the toner left on the recording medium by cleaning means, and fixing the toner image transferred to the recording medium by fixing means; a toner collection mode for transferring the toner from said cleaning means to said image carrier, an collecting the toner in said developing means; and a toner image sensing mode for forming a reference toner image on said image carrier, sensing a reflection density from the reference toner image by density sensing means, said operating, based on an output of said density sensing means, toner replenishing means for replenishing fresh toner to said developing means, or setting a developing condition matching the output of said density sensing means;

said apparatus comprising:

bias applying means for applying a bias voltage to said cleaning means such that said cleaning means does not contact the reference toner image in said toner image sensing mode, and such that an electric field for transferring the toner charged by said cleaning means to said cleaning means is formed between said image carrier and said cleaning means in said image formation mode; and control means for preventing, in said toner image sensing mode, said image transferring means from contacting the reference toner image, and then setting up said toner collection mode after the reference toner image has moved away from said cleaning means.

4. An image forming apparatus selectively operable in any one of an image formation mode for uniformly charging a photoconductive image carrier by charging means, optically exposing said image carrier to thereby electrostatically form a latent image, developing the latent image by developing means storing a toner and carrier mixture to thereby form a corresponding toner image, transferring the toner image to a recording medium by image transferring means, electrically collecting the toner left on the recording medium by cleaning means, and fixing the toner image transferred to the recording medium by fixing means a toner collection mode for transferring the toner from said cleaning means to said image carrier, and collecting the toner in said developing means; and a toner image sensing mode for forming a reference toner image on said image carrier, sensing a reflection density from the reference toner image by density sensing means, and operating, based on an output of said density sensing means, toner replenishing means for replenishing fresh toner to said developing means, or setting a developing condition matching the output of said density sensing means;

said apparatus comprising:

bias applying means for applying a bias voltage to said cleaning means such that said cleaning means does not contact the reference toner image in said toner image sensing mode, and such that an electric field for transferring the toner charged by said cleaning means to said cleaning means if formed between said image carrier and said cleaning means in said image formation mode; and control means for rendering, in said toner image sensing mode, said transferring means inoperative, causing said biasing means to apply a bias voltage identical in polarity with a charge of the toner stored in said developing means to said cleaning means, and then setting up said toner collection mode after the reference toner image has moved away from said cleaning means.

5. An image forming apparatus selectively operable in any one of an image formation mode for uniformly charging a photoconductive image carrier by charging means, optically exposing said image carrier to thereby electrostatically form a latent image, developing the latent image by developing means storing a toner and carrier mixture to thereby form a corresponding toner image, transferring the toner image to a recording medium by image transferring means, electrically collecting the toner left on the recording medium by cleaning means, and fixing the toner image transferred to the recording medium by fixing means; a toner collection mode for transferring the toner from said cleaning means to said image carrier, and collating the toner in said developing means; and a toner image sensing mode for forming a reference toner image on said image carrier, sensing a reflection density from the reference toner image by density sensing means, and operating, based on an output of said density sensing means, toner replenishing means for replenishing fresh toner to said developing means, or setting a developing condition matching the output of said density sensing means;

said apparatus comprising:

bias applying means for applying, in said toner image sensing mode, a bias voltage to said cleaning means such that an electric field formed between said image carrier and said cleaning means is the same as in said toner collection mode; and control means for setting up said toner collection mode immediately after the reference toner image has moved away from said cleaning means.

* * * * *